US005593312A

United States Patent [19]

McCracken

[11] Patent Number: 5,593,312

[45] Date of Patent: Jan. 14, 1997

[54] ELECTRICAL CORD LOCK

[75] Inventor: Robert E. McCracken, Tucson, Ariz.

[73] Assignee: Waxing Corporation of America, Inc., Elmhurst, Ill.

[21] Appl. No.: 488,269

[22] Filed: Jun. 7, 1995

[51] Int. Cl.[6] ..... H01R 13/62

[52] U.S. Cl. ..... 439/369; 439/370

[58] Field of Search ..... 439/366–373

[56] References Cited

U.S. PATENT DOCUMENTS

| | | | |
|---|---|---|---|
| 2,461,427 | 2/1949 | Kneebone | 173/322 |
| 3,781,761 | 12/1973 | Harwood . | |
| 4,183,603 | 1/1980 | Donarummo . | |
| 4,773,874 | 9/1988 | Kopeski, Jr. | 439/369 |
| 4,840,577 | 6/1989 | Prouty | 439/373 |
| 4,957,450 | 9/1990 | Pioszak | 439/369 |
| 5,336,106 | 8/1994 | Osten | 439/369 |
| 5,443,397 | 8/1995 | Carl | 439/369 |
| 5,470,249 | 11/1995 | Manganello | 439/369 |

*Primary Examiner*—Hien Vu

*Attorney, Agent, or Firm*—Fitch, Even, Tabin & Flannery

[57] ABSTRACT

A locking device for maintaining a mating connection between female and male ends of electrical cords is provided including a locking member which is a flat rigid element. Structure in the locking member is provided for receiving enlarged plug and socket heads on ends of electrical cords through the locking member. At least one slot is formed in the locking member connected to the enlarged head receiving structure with the slot being configured to substantially fix the cord receiving tension forces in a predetermined position in the slot.

11 Claims, 5 Drawing Sheets

ELECTRICAL CORD LOCK

FIELD OF THE INVENTION

The present invention relates to a locking device for electrical cords, and more particularly, a locking device for maintaining a mating connection between female and male ends of electrical cords.

BACKGROUND OF THE INVENTION

The problem of accidental separation of connected electrical cords at the mating connection between the cords, for example, at the mating connection between a pigtail electrical cord extending from a power tool or an electrical appliance and an extension cord, is a common one particularly as the power tool or appliance is operated and tension is applied to the interface between the pigtail cord and the extension cord such as when the tool or appliance is moved by the operator in a direction away from the electrical outlet into which the extension cord is inserted.

As such, several prior art devices have been disclosed to reduce the instances of the above-described electrical cord separation. U.S. Pat. No. 2,461,427 to Kneebone discloses an elongate member having a hook defining a space at one end and including an opening at the other end. The member is sized so that when the plug and socket head on the ends of the electrical cords are attached to one another with the cords extending through the space and opening respectively, the member is resiliently deformed into an arc to frictionally engage the hook and the edges of the opening against the respective cords. Over time, such resilient deformation can cause the member to fatigue reducing the frictional force engaging the cords and/or causing the member to fail.

U.S. Pat. No. 3,781,761 to Harwood discloses a strip of material having a series of apertures spaced along the strip opening to a side of the strip for receipt of a pair of cords each through at least one aperture. Tension applied to a cord will be absorbed by the strip as by slight flexure thereof. Similar to the device disclosed by Kneebone, the strip is subject to fatigue by the flexure caused by repeated use and application of tension to cords therein. Further, the apertures are open to the side of the strip such that any force applied to the cord in the direction of the strip side can cause the cords to become dislodged from the strip.

U.S. Pat. No. 4,183,603 to Donarummo discloses a cord lock having a U-shaped body with parallel end legs having cord-receiving apertures therein with the male plug and female socket of the respective cords being connected between the legs. The cords are prevented from separation by being captured tightly between the end legs such that any tension applied to a cord causes the plug or socket head to abut the adjacent end leg before detaching from the other cord. Thus, the distance between end legs must be selected so that the distance is only slightly greater than the length of the connected plug and socket therebetween so that for any variations in the length of the connected plug and socket a different U-shaped body must be provided.

U.S. Pat. No. 4,773,874 to Kopeski, Jr. discloses a U-shaped clip having end portions on the legs which are curled over towards the bottom of the clip. The end legs have slots leading to respective openings for receipt of cords therethrough allowing plug and socket heads to be connected between the end legs. With such a connection, the curled over portions of the end legs engage the top of the heads and force them downwardly towards the bottom of the clip. Again, such flexure of the clip, and specifically the curled-over end portions, subject the clip to fatigue and possible failure upon repeated usage thereof. Moreover, similar to the device disclosed by Donarummo, the clip is designed such that the plug and socket heads fit closely between the end legs such that plug and socket heads of varying lengths would require a differently sized clip.

U.S. Pat. No. 4,957,450 to Pioszak discloses a strap which is wrapped around connected plug and socket heads and then connected to itself by a Velcro hook and loop fastening system. Such a fastening system can be a problem when used outdoors as the hooks and loops employed therein can become clogged with ice and snow or dirt and the like and lose their fastening ability. In another embodiment, the strap is attached directly to the bottom of the male plug and is wrapped around the female socket head connected to the male plug and attached to the top of the male plug head. The male plug head is custom-made with posts on the top of the male plug and the strap is provided with a series of holes which can be aligned with the posts to connect the strap to the top of the male plug. The use of specially-made plug heads having posts increases manufacturing costs, and accordingly is not desirable.

U.S. Pat. No. 5,336,106 to Osten discloses a connector having flexible thumb tabs which allow cords to be inserted into openings at either end of the connector. Again, similar to other devices using flexible members, the flexible thumb tabs are subject to failure upon repeated usage.

SUMMARY OF THE INVENTION

In accordance with the present invention, a locking device for maintaining a mating connection between female and male ends of electrical cords is provided which overcomes the aforementioned problems of the prior art.

In one form of the invention, the locking device includes a locking member which can be a flat rigid element. Structure in the locking member is provided for receiving enlarged plug and socket heads on ends of electrical cords through the locking member. At least one slot is formed in the locking member connected to the enlarged head receiving structure with the slot being configured to substantially fix a cord receiving tension forces in a predetermined position in the slot.

The enlarged head receiving structure can be a generally central aperture formed in the locking member sized to receive plug and socket heads therethrough. Preferably, there is a pair of elongate slots formed in the member on opposite sides of the aperture connected thereto and extending radially away therefrom. The pair of elongate slots can each be defined by an arcuate surface region spaced from the central aperture. The arcuate surface region is connected to two parallel straight wall surface regions leading to the central aperture with the arcuate surface region and sections of the straight wall surface regions adjacent the arcuate surface region cooperating to engage electrical cords receiving tension forces extending through the slots.

Preferably, the slot is sized to slightly compress an electrical cord inserted therein.

The rigid element can be formed from a plastic material.

The rigid element may be formed in the shape of a diamond.

In one form, the locking device is provided in combination, with an electrical cord wherein the cord has an enlarged plug or socket head and the member includes an enlarged cord head retaining hole spaced from the locking member aperture. The cord is threaded through the retaining hole with the hole being sized sufficiently small to prevent the enlarged head from fitting through the hole while still permitting the cord to be fit therethrough so that the rigid body cannot be removed from the electrical cord.

Preferably, the cord has spaced ends with one end including the enlarged plug or socket head and the other end being electrically connected to a power tool.

In another form of the invention, the locking device includes an elongate aperture plate and a generally central aperture formed in the plate sized for allowing enlarged plug and socket heads on ends of electrical cords to be sequentially inserted through the aperture with the cords inserted through the aperture being in an unlocked movable position in the aperture relative to the plate. Locking structure is provided on the plate for allowing cords to be moved from the unlocked position to a locked position wherein in the locked position cord portions frictionally engage the plate and are substantially fixed in a predetermined position relative thereto for reducing tension transmitted through the cords to the interface of the attached mating plug and socket heads to thereby limit disconnection of the mating attachment caused by cord tension.

The tension reducing locking structure can include structure for exerting a binding force on cords extending through the plate to bind cord portions engaging the plate in the locked position relative thereto.

Preferably, the aperture has a circular shape and the tension reducing locking structure includes a pair of slots formed in the plate leading to the aperture spaced approximately 180 degrees from each other about the circular aperture.

The plate can have opposite substantially flat sides with the aperture and slots extending through the plate between the sides. The cords mating connection can be adjacent one of the opposite sides. In the locked position cords extend through respective slots from the mating connection adjacent the one side to the other of the opposite sides so that tension applied to portions of the cords adjacent the other side is substantially reduced prior to being transmitted to portions of the cords adjacent the one side extending from the mating connection.

In one form, the locking device described above is provided in combination with an electrical cord.

In another form of the invention, a locking assembly for maintaining a mating connection between female and male ends of electrical cords is provided. The locking assembly includes an electrical cord having one of an enlarged female socket and male plug head at an end thereof for connection to a mating head of another electrical cord. An elongate locking member includes a rigid aperture plate having two opposite flat sides. A central aperture in the plate to allow passage of the enlarged head through the locking plate with the cord extending through the aperture. Structure is provided for capturing a portion of the electrical cord as it receives tension in a substantially fixed predetermined position relative to the plate between the opposite sides thereof.

Preferably, the capturing structure includes at least one elongate slot leading to the central aperture with the slot and cord being sized to slightly compress the cord as it is being moved from the aperture and is inserted in the slot.

DETAILED DESCRIPTION OF THE PREFERRED EMBODIMENTS

Figure 1:
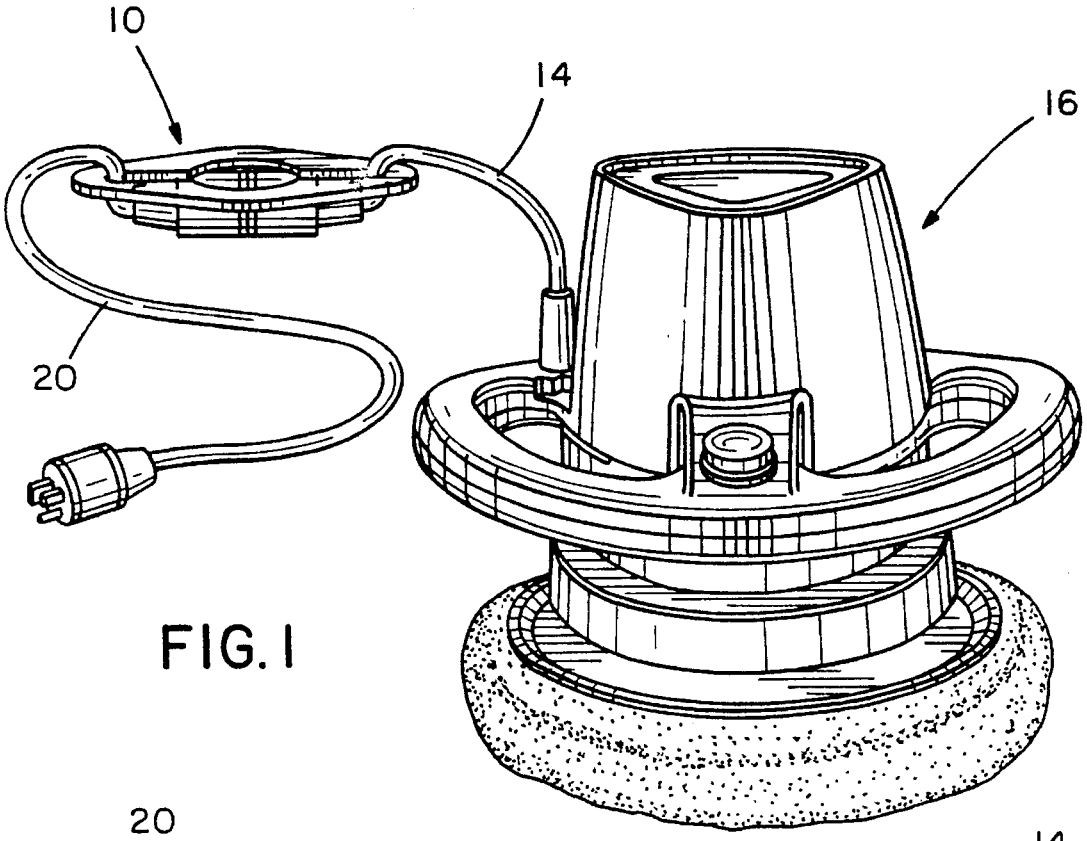
FIG. 1 is a perspective view of the locking device for maintaining a connection between female and male ends of electrical cords according to the present invention.
Figure 2:
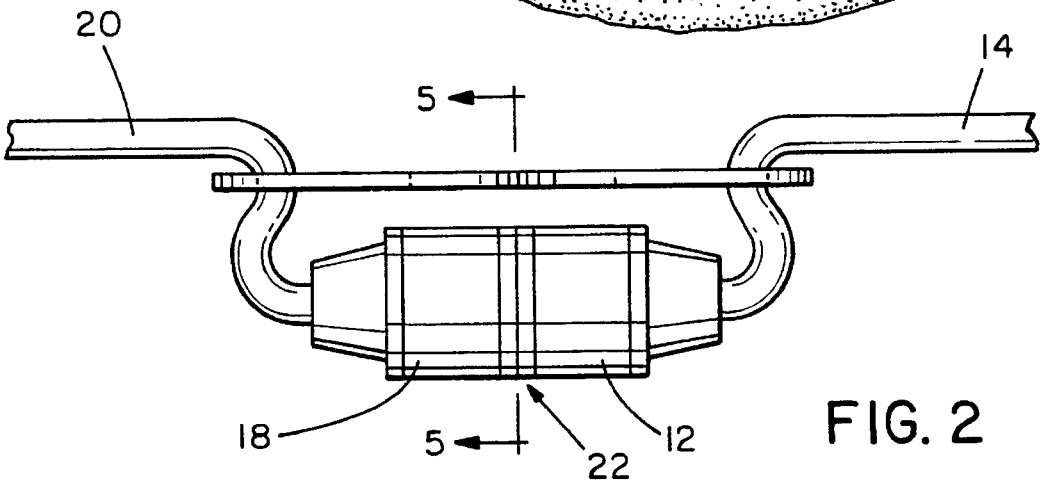
FIG. 2 is an elevational view of the locking device showing a flat, rigid plate having cords extending therethrough in a locked position.
Figure 3:
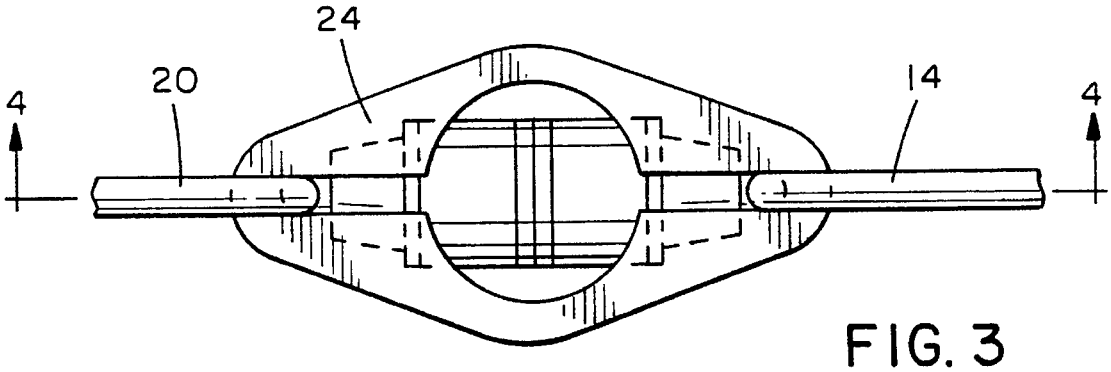
FIG. 3 is a plan view of the locking device of FIG. 2.
Figure 4:
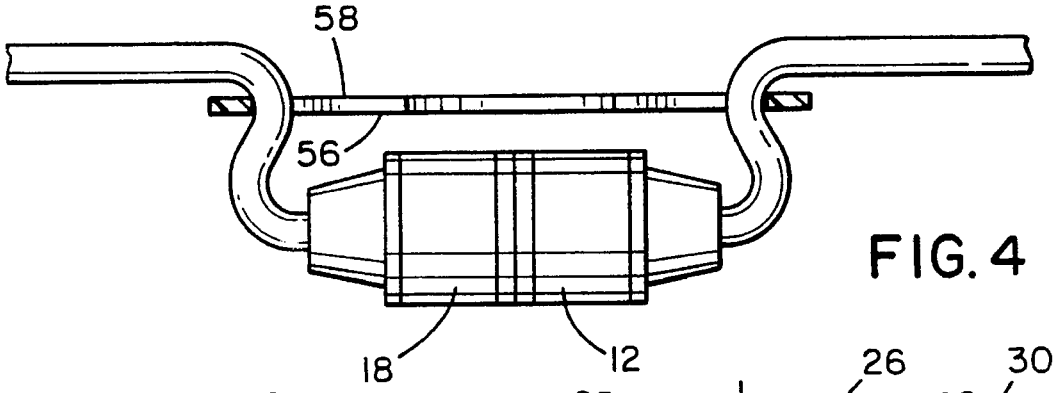
FIG. 4 is a cross-sectional view taken along line 4—4 of FIG. 3.
Figure 5:
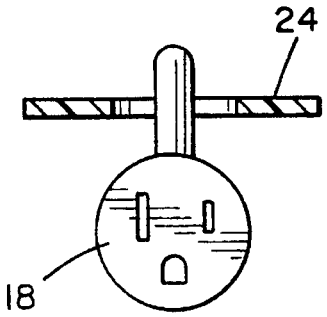
FIG. 5 is a cross-sectional view taken along line 5—5 of FIG. 2 illustrating the female socket head.

The locking device 10 of the present invention is illustrated in FIG. 1. As seen in FIG. 1, the locking device 10 is effective to maintain a mating connection between an enlarged male plug head 12 and a female socket head 18.

The male plug head 12 can be disposed on one end of a pigtail electrical cord 14 electrically attached to an electrical appliance or a power tool, such as an orbital waxer/polisher 16, at its other end. The enlarged plug head 12 has male prongs thereon which are received in correspondingly-shaped openings in the enlarged socket head 18 on another electrical cord 20, such as on an extension cord, with the other end of the extension cord 20 being plugged into an electrical outlet or another extension cord to allow the orbital polisher 16 to be used at locations removed from the outlet depending upon the length and number of extension cords used.

Figure 6:
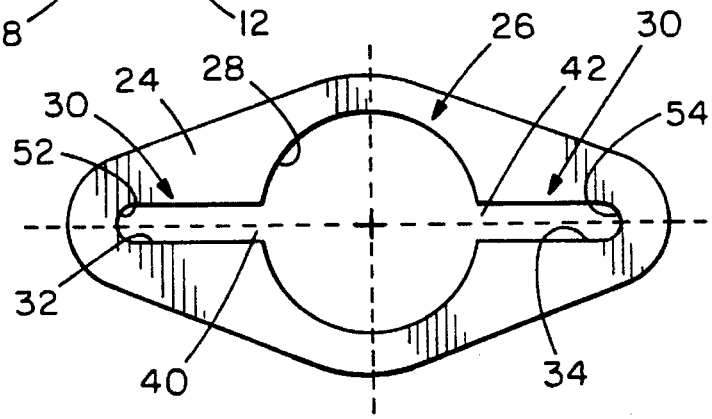
FIG. 6 is a plan view of the flat, rigid plate having a central aperture and elongate slots extending therefrom.

Typically, tension applied along the cords 14 and 20 causes them to separate one from another at the interface 22 of the mating connection between the male plug head 12 and female socket head 18. To substantially reduce the instances of such separation, the locking device 10 of the present invention includes a flat, rigid plate 24, as best seen in FIG. 6. By providing a rigid plate 24, the fatigue problem which can occur in many of the previously-described flexible, resiliently deformable devices is avoided.

The rigid plate 24 includes structure 26 for receiving the enlarged plug head 12 and socket head 18 through the plate 24 in the form of a generally central aperture 28 formed in the plate 24. The central aperture 28 is sized sufficiently large so that the enlarged heads 12 and 18 can be sequentially inserted therethrough before being moved to their locked position relative to the plate 24. The plate 24 is also provided with locking structure in the form of a pair of slots 32 and 34 formed in the plate. The slots each connect to the central aperture 28 and extend radially away therefrom. The slots 32 and 34 can be spaced 180 degrees from each other about the aperture 28. The slots 32 and 34 can be sized such that they can slightly compress the cords 14 and 20 when slid therein. In this manner, if a cord is inserted in the slot and receives a force directed toward the aperture 28, the frictional forces created by the sizing of the slots will resist the tendency for the cord to slide out of the slots and back into the aperture 28. For differently sized cords, such as for heavy duty applications, the slots 32 and 34 can be sized differently so as to compress thicker, heavy duty cords accordingly.

Figure 7:
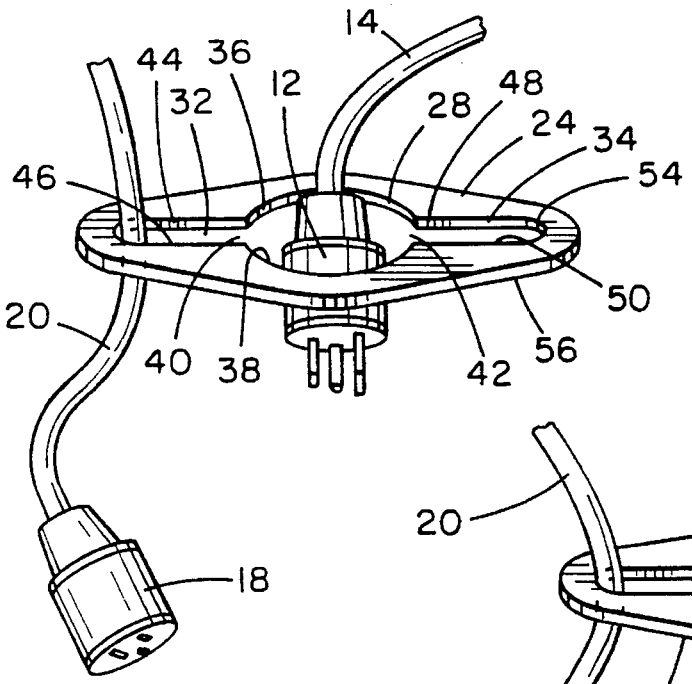
FIG. 7 is a perspective view of the locking device illustrating the insertion of the enlarged male plug head through the central aperture of the plate.

Thus, to use the plate 24 with, for example, an orbital polisher 16, the plug head 12 and socket head 18 are sequentially inserted through the central aperture 28. As shown in FIG. 7, the socket head 18 of the extension cord 20 can be first inserted through the aperture 28 with the cord 20 then being slid into the slot 32. Next, the plug head 12 of the pigtail cord 14 is inserted through the aperture 28 with the cord 14 then being slid into slot 34 such that the socket head 18 and plug head 12 can be mated adjacent the plate 58, as seen in FIGS. 1–4. Of course, the sequence of cord insertion is not part of the present invention and, depending on the size of the cord heads and aperture 28, can occur simultaneously. Various lengths of connected plug and socket heads can be accommodated as the mating connection is suspended on one side of the rigid plate 24.

In practice, when an appliance or power tool, such as orbital polisher 16, is being used and the slack in the cord is taken up, as when the polisher 16 moved further away from the electrical outlet, tension created by tightening of the slack in the cords will be substantially diverted around the interface 22 from one cord to the other, thereby substantially limiting disconnections of the mating connection caused by such tension forces. Further, where several extension cords are used, an appropriate number of plates 24 can be used adjacent each mating connection to limit disconnections thereat.

Figure 8:
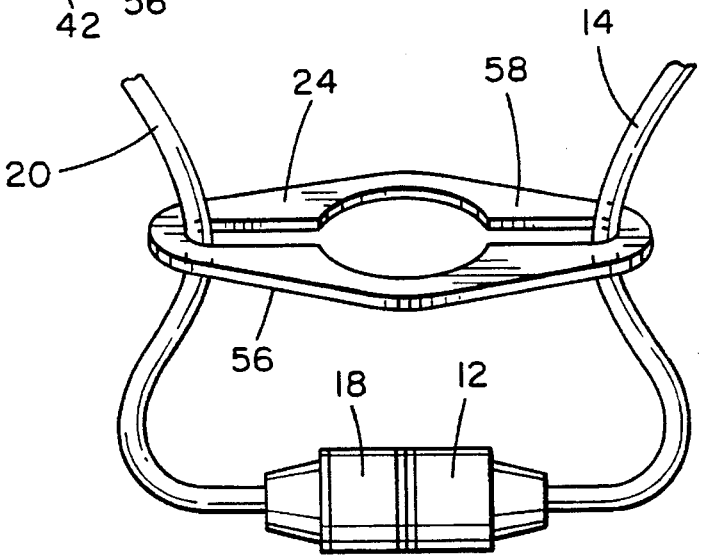
FIG. 8 is a perspective view illustrating electrical cords inserted into slots in the plate and the mating connection of the enlarged cord heads.
Figure 9:
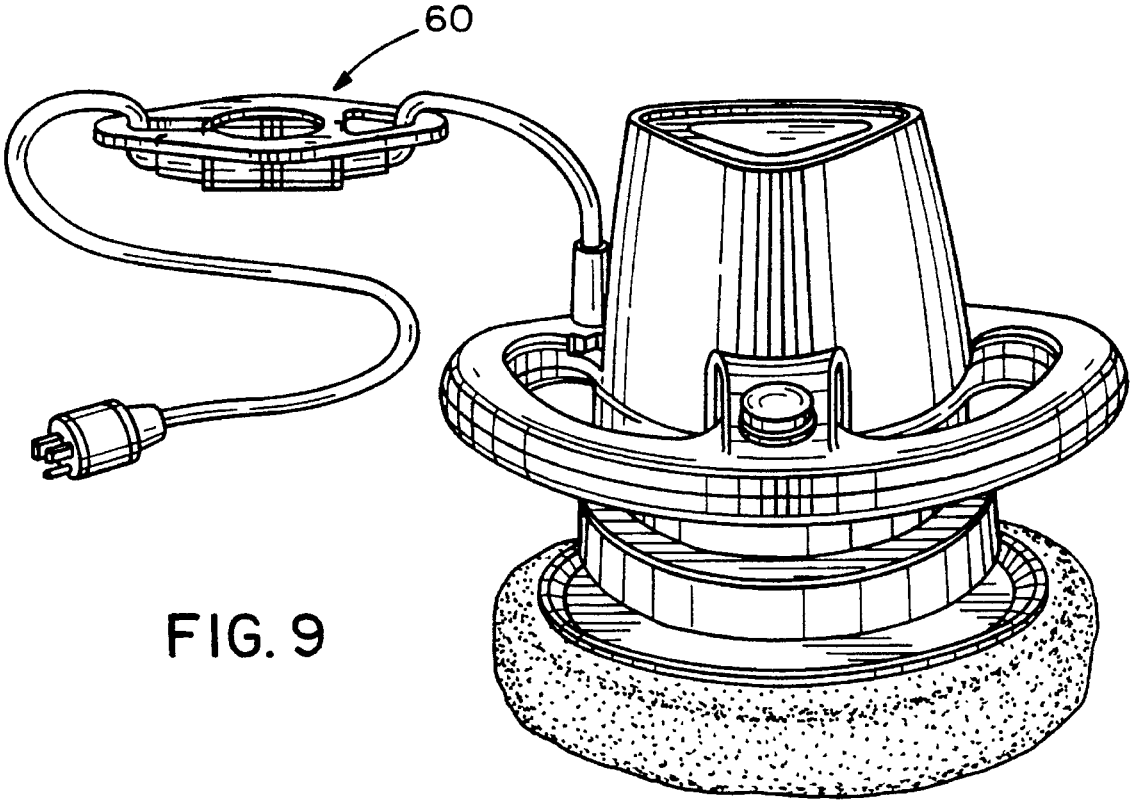
FIG. 9 is a perspective view, similar to FIG. 1, of a locking assembly wherein a modified plate is permanently captured on a pigtail electrical cord attached to an orbital polisher according to another embodiment of the invention.
Figure 10:
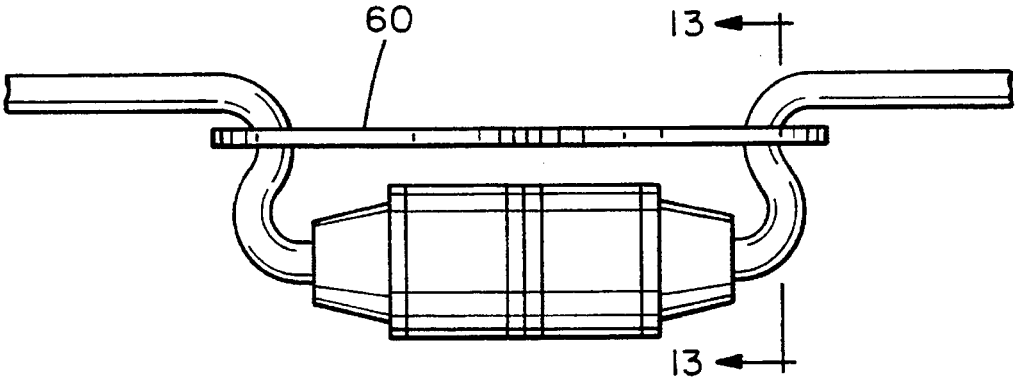
FIG. 10 is an elevational view of the locking assembly of FIG. 9 showing the mating connection between the enlarged cord heads.
Figure 11:
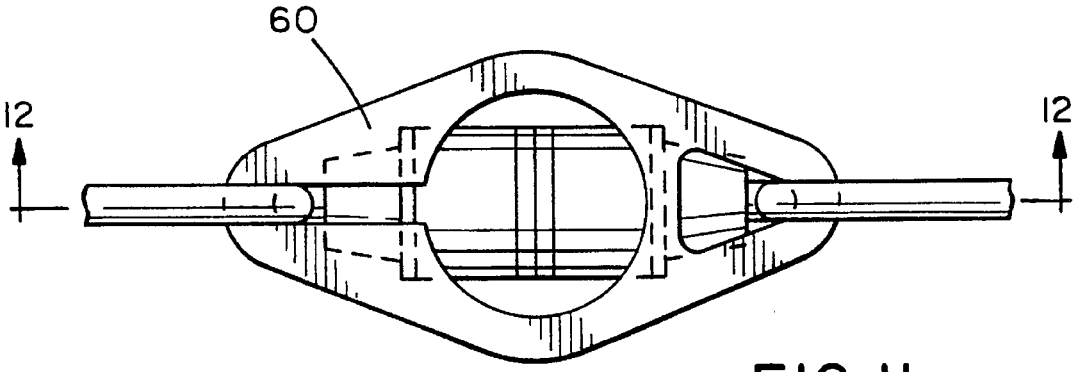
FIG. 11 is a plan view of the locking assembly of FIG. 10.
Figure 12:
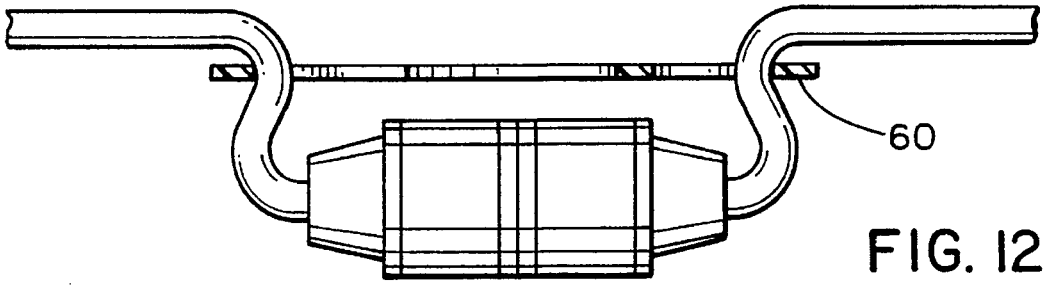
FIG. 12 is a cross-sectional view taken along line 12—12 of FIG. 11.
Figure 13:
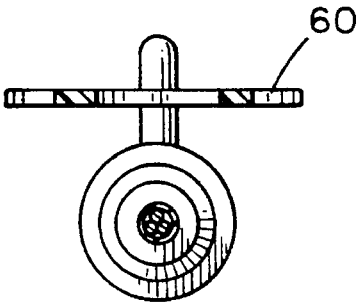
FIG. 13 is a cross-sectional view taken along line 13—13 of FIG. 10.

More specifically, referring to FIGS. 6–8, the plate 24 preferably is formed from a plastic material and has a diamond shape about its periphery with the aperture 28 centered at the intersection of the major and minor axes of the diamond-shaped plate 24. The central aperture 28 is formed by two opposed semicircular wall regions 36 and 38 being separated from each other at either end thereof by respective spaces 40 and 42 leading to slots 32 and 34. The slot 32 and the slot 34 each have parallel straight wall surface regions, 44 and 46, and 48 and 50, respectively, which lead radially away from the spaces 40 and 42 to respective arcuate surface regions 52 and 54.

The straight wall regions 44 and 46 and 48 and 50 preferably are spaced from each other as at 40 and 42 at a distance that is slightly less than the diameter of the cords 20 and 14 such that to insert the cords 20 and 14 into the slots 32 and 34 they must be press-fit through the entries 40 and 42 into the slots 32 and 34 thereby creating a frictional resistance to forces on the cords 20 and 14. Thus, once inserted in the slots, the cords will not easily slide back into the aperture 28 due to the frictional resistance to forces directed along the length of the slots which can be generated during normal usage of the appliance.

The cords 20 and 14 can be slid along the slots 32 and 34 to the ends thereof such that the portion of cord 20 in the slot 32 engages the arcuate surface region 52 with the portion of cord 14 in the slot 34 similarly engaging the arcuate surface region 54. Portions of the cords 14 and 20 adjacent the heads 12 and 18 are then curled so that the heads 12 and 18 face each other for connection. It should be noted that the longer the connected heads are in relation to the distance between the ends of the slots, the more the cords must be curled to effect the connection of the heads. After connecting the heads 12 and 18 such that they extend in a direction generally parallel to the plate 24, as shown in FIG. 8, the cords 20 and 14 can be slid against the compressive forces exerted by the slots 32 and 34 of the plate 24 so that the mating connection is not suspended very far below the plate 24 and is directly beneath the lower side 56 of the plate 24 with the cords 20 and 14 extending through the plate slots 32 and 34 and the cord 20 being connected at its other end to an outlet or another extension cord and the cord 14 to the appliance.

When operation of the appliance or power tool causes the slack in the cords to be taken up, the tension created by the tightening of the cords will be transmitted to portions of the cords adjacent the upper side 58 of the plate 24 causing the portions of the cords in the slots to frictionally engage the walls of the slots and be bound in a substantially predetermined fixed position therein; namely, at the end of the slots 32 and 34 frictionally engaging respective accurate surface regions 52 and 54. In this manner, the tension in the cords will be substantially reduced before being transmitted to portions of the cord adjacent the lower side 56 of the plate 24 as most of the tension will be absorbed by the rigid plate 24 and transferred around the interface 22 from one cord to the other. Thus, the interface 22 of the heads 12 and 18 will experience little or no tension during normal usage of the appliance or power tool 16, thereby significantly reducing the potential occurrences of accidental disconnection at the interface 22.

FIGS. 9–16 illustrate alternative embodiments wherein the plate 24 is slightly modified so that it permanently receives one of the pigtail cord 14 and extension cord 20 therethrough.

Figure 14:
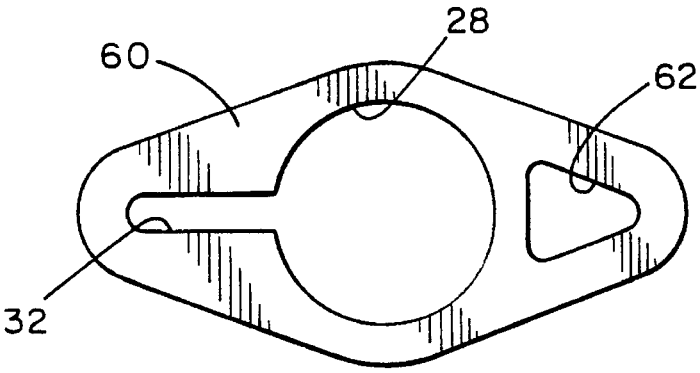
FIG. 14 is a plan view of the modified plate of the locking assembly of FIG. 9.
Figure 15:
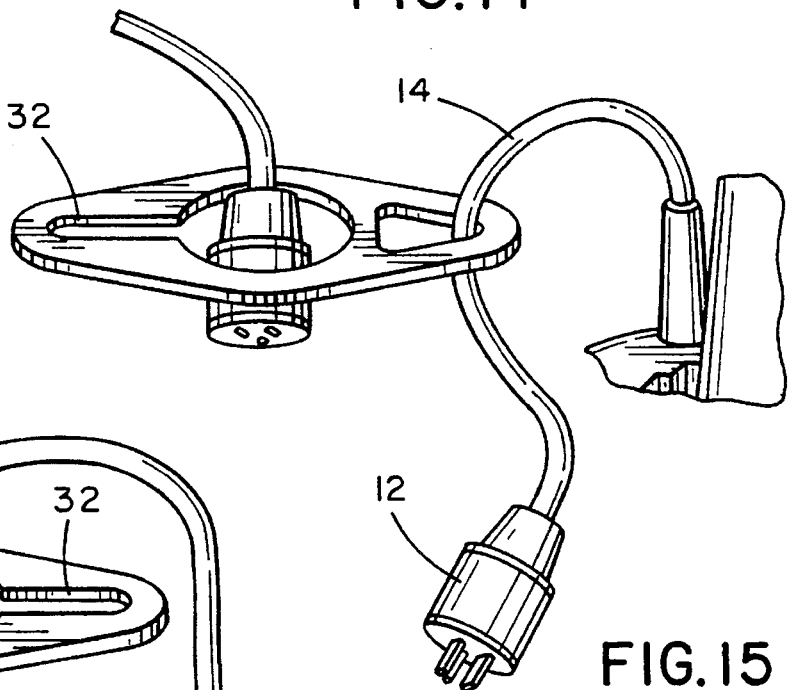
FIG. 15 illustrates the female socket head inserted through the aperture of the modified plate with the modified plate permanently captured on the pigtail cord.
Figure 16:
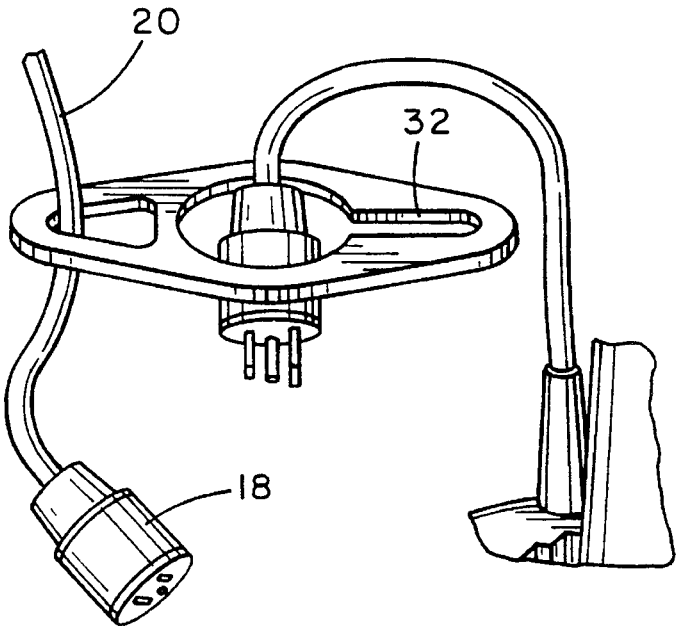
FIG. 16 illustrates an alternative embodiment of the locking assembly of FIG. 9 wherein the modified plate is permanently captured on an extension cord and the pigtail cord is inserted through the plate aperture.
Figure 17:
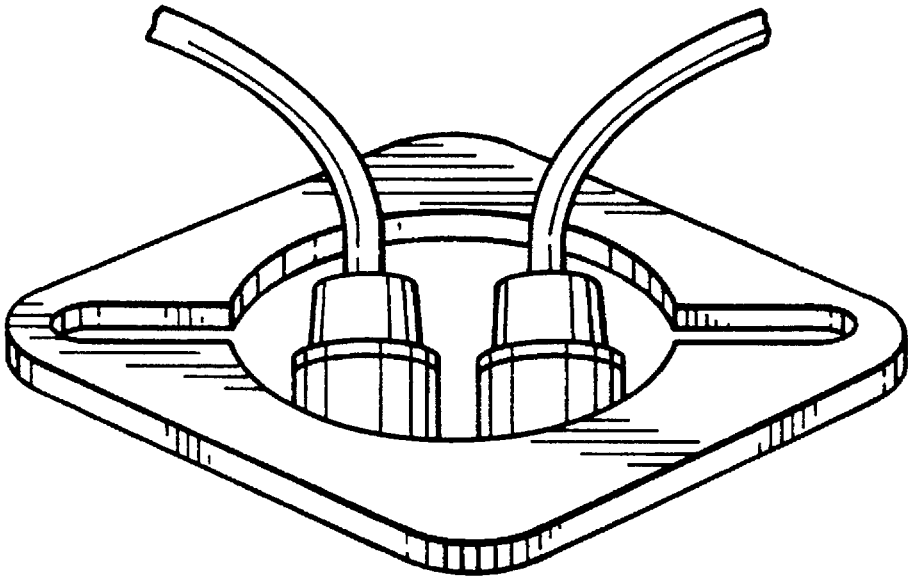
FIG. 17 is a perspective view of the locking device and the enlarged heads of electrical cords with the relative size of the locking device central aperture and enlarged cord heads allowing the cord heads to be inserted simultaneously through the central aperture of the plate.

The alternative plate 60 is best seen in FIG. 14. Plate 60, similar to plate 24, includes a central aperture 28 and an elongate slot 32 on one side of the aperture 28. The slot 34 in plate 24 has been removed in plate 60 and replaced with a triangular-shaped hole 62 spaced from the central aperture 28. The hole 62 is sized such that either one of the pigtail cord 14 (FIG. 15) or the extension cord 20 (FIG. 16) can be fit therethrough while being sufficiently small to prevent the plug head 12 or socket head 18 from also fitting through the hole 62 to thereby capture the plate 60 onto the cord. In this manner, the plate 60 is permanently captured on the pigtail cord 14 or extension cord 20.

It will be noted that whichever cord 14 or 20 is threaded through the hole 62 will not undergo the binding force provided by the removed slot 34, thereby leaving the length of the other cord extending through the slot 32 to be the only cord which receives tension that will be substantially fixed in a locked position relative to the plate 60. As such, only the tension applied to the cord extending through the slot 32 will be reduced before reaching the interface 22 of the mating plug head 12 and socket head 18 connection. Thus, such an arrangement is still effective in reducing the instances of disconnection at the interface 22 caused by tension applied to the cord extending through the slot 32.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

What is claimed is:

1. A locking device for maintaining a mating connection between female male ends of electrical cords, the locking device comprising:

a locking member comprising a flat rigid element having opposed flat sides;

aperture means in the locking member for receiving an electrical cord having an enlarged plug head or socket head at an end thereof to be inserted through said aperture means in a direction from one side to the other side of opposed flat sides; and at least one elongated slot extending transversely with respect to said insertion direction, said at least one slot formed in the locking member connected to the aperture means and being configured so that after the cord and its head are inserted through the aperture means the cord can be slid in the slot, and so that the cord is press fit into the slot thereby creating a frictional resistance to force on the cord.

2. The locking device of claim 1 wherein the aperture means comprises a generally central aperture formed in the locking member sized to receive plug and socket heads therethrough with the at least one slot comprising a pair of elongate slots formed in the member on opposite sides of the aperture connected thereto and extending radially away therefrom.

3. A locking device for maintaining a mating connection between female and male ends of electrical cords, the locking device comprising:

a locking member comprising a flat rigid element having top and bottom surfaces;

aperture means in the locking member for receiving enlarged plug and socket heads on ends of electrical cords through the locking member; and at least one slot formed in the locking member connected to the aperture means and being configured to substantially fix a cord receiving tension forces in a predetermined position in the slot, wherein the aperture means comprises a generally central aperture formed in the locking member sized to receive plug and socket heads therethrough, said at least one slot comprising a pair of elongate slots formed in the member on opposite sides of the aperture connected thereto and extending radially away therefrom, and the pair of elongate slots each have an arcuate end portion spaced from the central aperture and connected to two parallel straight walls leading to the central aperture, the arcuate end portions and sections of the straight walls cooperating to engage electrical cords when said plug and socket heads are inserted through said aperture means from the top surface through the bottom surface of the flat rigid element.

4. The locking device of claim 1 wherein the at least one slot is sized to slightly compress an electrical cord inserted therein.

5. The locking device of claim 1 wherein the rigid element is formed from a plastic material.

6. The locking device of claim 1 wherein the rigid element has a diamond shape.

7. The locking device of claim 1 in combination with an electrical cord wherein the cord has an enlarged plug or socket head and the member includes an enlarged cord head retaining hole spaced from the aperture means with the cord extending therethrough and the hole being sized sufficiently small to prevent the enlarged head from fitting through the hole while still permitting the cord to be fit therethrough so that the electrical cord cannot be removed from the rigid element.

8. The locking device of claim 7 wherein the cord has spaced ends with one end including the enlarge plug or socket head and the other end being electrically connected to a power tool.

9. A locking device for maintaining a mating connection between female and male ends of electrical cords, the locking device comprising:

a flat elongate rigid plate having top and bottom surfaces;

a generally central aperture formed in the plate sized for allowing enlarged male plug and female socket heads on ends of electrical cords to be sequentially inserted through the aperture with cords inserted through the aperture from the top surface to the bottom surface and with the electrical cord being in an unlocked movable position in the central aperture relative to the plate; and slot means on the plate to guide movement of the cords from the unlocked position with cords extending through the aperture to a locked position where portions of the cord can be slid in the slot means, wherein in the locked position the cord portions frictionally engage the plate and are substantially fixed in a predetermined position relative thereto for reducing tension transmitted through cords to the interface of attached mating plug and socket heads thereby limiting disconnection of the mating attachment caused by cord tension.

10. The locking device of claim 9 wherein the aperture has a circular shape and the slot means comprises a pair of slots formed in the plate leading to the aperture spaced approximately 180 degrees from each other about the circular aperture.

11. The locking device of claim 10 wherein the plate has opposite substantially flat sides and the aperture and slots extend through the plate between the sides with the mating connection between the plug and socket head being adjacent one of the opposite sides and with the cords in the predetermined fixed position the cords extend through respective slots from the mating connection adjacent the one side to the other of the opposite sides and tension applied to portions of the cords adjacent the other side is substantially reduced prior to being transmitted to portions of the cords adjacent the one side.

* * * * *

UNITED STATES PATENT AND TRADEMARK OFFICE

CERTIFICATE OF CORRECTION

PATENT NO. : 5,593,312

DATED : January 14, 1997

INVENTOR(S) : Robert E. McCracken

It is certified that error appears in the above-indentified patent and that said Letters Patent is hereby corrected as shown below:

Column 7, line 18, claim 1, change "female male" to --female and male--.

Column 7, line 27, claim 1, after "of" insert --said--.

Column 8, line 28, claim 9, change "elongate" to --elongated--.

Signed and Sealed this

Seventeenth Day of June, 1997

Bruce Lehman

*Attest:*

BRUCE LEHMAN

*Attesting Officer*

*Commissioner of Patents and Trademarks*